United States Patent [19]

Gerhardt

[11] Patent Number: 4,923,384

[45] Date of Patent: May 8, 1990

[54] CONTINUOUS PRESS FOR HOT PRESSING A MAT

[75] Inventor: Klaus Gerhardt, Rheurdt, Fed. Rep. of Germany

[73] Assignee: G. Siempelkamp GmbH & Co., Krefeld, Fed. Rep. of Germany

[21] Appl. No.: 339,181

[22] Filed: Apr. 14, 1989

[30] Foreign Application Priority Data

May 14, 1988 [DE] Fed. Rep. of Germany ..... 3816511

[51] Int. Cl.[5] ..... B30B 5/04

[52] U.S. Cl. ..... 425/371; 100/93 RP; 100/154; 156/583.5

[58] Field of Search ..... 100/93 RP, 153, 154; 156/555, 583.5; 425/371

[56] References Cited

U.S. PATENT DOCUMENTS

| | | | |
|---|---|---|---|
| 3,907,473 | 9/1975 | de Mets | 425/371 |
| 4,140,455 | 2/1979 | de Mets | 425/371 |
| 4,375,350 | 3/1983 | Sato | 425/371 |
| 4,449,448 | 5/1984 | Stabler et al. | 100/154 |
| 4,480,978 | 11/1984 | Gerhardt | 425/371 |
| 4,613,293 | 9/1986 | Gerhardt | 425/371 |
| 4,621,999 | 11/1986 | Gerhardt | 425/371 |
| 4,645,632 | 2/1987 | Bottger et al. | 100/154 |
| 4,647,417 | 3/1987 | Bottger et al. | 425/371 |
| 4,718,843 | 1/1988 | Carlsson et al. | 100/154 |
| 4,748,907 | 6/1988 | Schermutzki | 100/153 |

FOREIGN PATENT DOCUMENTS

| | | |
|---|---|---|
| 2222419 | 11/1972 | Fed. Rep. of Germany . |
| 3413396 | 10/1985 | Fed. Rep. of Germany . |
| 3432548 | 10/1986 | Fed. Rep. of Germany . |

*Primary Examiner*—Jay H. Woo
*Assistant Examiner*—C. Scott Bushey
*Attorney, Agent, or Firm*—Herbert Dubno

[57] ABSTRACT

The continuous press for hot pressing a mat as a step in making chipboard, fiberboard, laminated board and similar composite materials comprises heated platens, upper and lower pressing plates and press belts which are guided on roll rods in a pressing region which run between the heated platens and the press belts. The roll rods are guided over a guideway around the upper and/or lower pressing plate with the help of an upper and a lower roll rod circulating mechanism which has guide chains and a roll rod feed mechanism with entrance-end roll rod feed wheels. Roll shoes are located at the entrance end in the vicinity of the guide drums for the pressing belts and the roll rod feed mechanisms. The associated press belts are guided with the roll shoes. The roll shoes also have auxiliary rolls which are guided over another guideway and which are guided on the press belt side over shape-determining guide surfaces. The roll shoes and the entrance-end roll guide wheels have common side walls which are connected with hot platen portions protruding beyond the pressing plates. Closing piston-cylinder units can be connected between the side walls and the press frame, with which the gap width between the roll shoes in the vicinity of the roll rod feed wheels may be adjusted by deformation of the protruding hot platen portions.

12 Claims, 6 Drawing Sheets

CONTINUOUS PRESS FOR HOT PRESSING A MAT

CROSS REFERENCE TO RELATED APPLICATIONS

This application relates to the following commonly owned U.S. Pat. Nos: 4,850,846 issued July 25, 1098; 4,854,026 issued Aug. 8, 1989; 4,726,871 issued Feb. 23 1988; 4,727,973 issued Mar. 1 1988; 4,645,632 issued Feb. 24 1987; and 4,647,417 issued Mar. 3 1987.

FIELD OF THE INVENTION

My present invention relates to a continuous press and, more particularly, to a continuous press for hot pressing a mat for making fiberboard, chipboard, laminated board or the like composite materials, generically described as pressed board.

BACKGROUND OF THE INVENTION

In German Pat. No. 34 32 548 there is described a continuous press for hot pressing a mat for making chipboard, fiberboard, laminated board and other composite materials comprises a press frame, a lower pressing plate with a heated platen, an upper pressing plate with another heated platen and endless press belts guided about the pressing plates with the aid of guide drums, which form an entrance mouth in the vicinity of the guide drums and a press gap in a pressing region.

The press belts are guided in the pressing region on roll rods, which circulate between the hot platens and the press belts and the roll rods are guided around the upper and lower pressing plates on a guideway with the help of an upper and lower roll rod circulating mechanism having guide chains and a roll rod feed mechanism with entrance-end roll rod feed wheels.

The lower pressing plate is located in the press lower portion while the upper pressing plate is located in the press upper portion.

By a "laminated board" I mean one used in making a circuit board for a printed circuit, such as a board with an insulating substrate or core having a glass fiber reinforcement embedded in an epoxy resin system and having one or more metal foil layers. The roll rod feed mechanism feeds the roll rods between the press belts and a heated platen or upstream associated platen in the pressing region.

In the press of German Pat. No. 34 32 548, the press belts run freely in the region between the guide drums and the roll rod feed mechanism. Of course, depending upon to the thickness of the mat fed into the mouth pressing can occur even in this region. However in this region the pressing is not controllable although such a control is often highly desirable according to the mat being pressed.

To influence the course of the pressing in the entrance region in continuous pressing as described above other devices or mechanisms are already known as described in German Pat. No. 22 22 419. Thus slide shoes are connected in the pressing region. However with the slide shoes continuous pressing of the above described type with roll rod circulation and roll rod feed mechanisms is barely possible and no operating adjustment for a variety different pressing course curves is possible.

OBJECTS OF THE INVENTION

It is an object of my present invention to provide a continuous press of the above-described type so that the pressing course curve can be fit to the operating conditions and the press output can be adjusted and set at the entrance of the press.

Another object is to provide an apparatus which overcomes drawbacks of the earlier continuous presses.

SUMMARY OF THE INVENTION

This object and others which will become more readily apparent hereinafter are attained in accordance with my invention in a continuous press for hot pressing a mat as described above.

According to my invention the press, further comprises a roll shoe located in a region between the guide drums for the press belts and the roll rod feed mechanisms, the press belt being guided by the roll shoe which has a plurality of auxiliary rolls fed over another guideway, which are guided on the press belt side over shape-determining guide surfaces.

The roll shoe and the entrance-end roll rod feed wheels have common side walls, which are connected with hot platen portions protruding beyond the upper and lower pressing plates.

A closing piston-cylinder unit is connected between the side wall and the press frame.

The gap width between the roll shoe in the vicinity of the roll rod guide wheels under elastic deformation of the protruding hot platen regions is adjustable.

Basically it is known from German Pat. No. 34 13 396 to adjust the entrance gap in the entrance region by elastic deformation of the press components although this patent deviates in other respects from the system of the invention. Thus the upper pressing plate is elastically deformable and also the upper press platen is movable according to the press opposing pressure and also against the action of the press piston-cylinder unit for a predetermined deformation play.

My invention uses the discovery that in a continuous press of the above-described type hot platen portions extending beyond the pressing plates can be formed which can fulfill their hot platen function and also can be used as leaf spring-like elements in combination with other features of my invention to adjust the pressing gap in the entrance region and thus the course of the pressing or the pressing course curve for different operating conditions and pressing curves.

In general, I can provide slide shoes in the region between the roll shoes and the roll rod feed wheels.

According to an advantageous embodiment of my invention the auxiliary rolls are constructed to be of the same width as the width of the press rolls and have a diameter which is twice the diameter of the roll rods of the roll rod circulating mechanism. Thus the auxiliary rolls can be driven or rotated by driven chains.

The shape-determining guide surfaces can be adjusted to the roll shoes so that they influence the pressing course curves according to predetermined parameters. It is particularly advantageous for the shape-determining guide surfaces to have a radius of curvature which approximately corresponds to that of the guide drum. These features lead at the same time to avoidance of disadvantageous deformations of the press belts in a region between the guide drums and the roll rod feed wheels.

Both regarding adjustment of the pressing course curve in the entrance pressing region and also in the running direction of the press belts it is advantageous to connect to the protruding hot platen portions hot platen transition portions extending in the running direction of the press belt, which have a clearance space from the upper and lower pressing plates.

Thus the structure is designed s that the hot platen transition portions are deformed elastically on operating the closing piston-cylinder units. Furthermore the apparatus can also be designed so that wedge drive is positioned between the hot platen transition portions and the pressing plates in the clearance space and because of that the press gap between these hot platen transition portions is variable or adjustable in the running direction of the press belts so that also in this region the pressing course curve can be influenced according to the press output.

To make a suitable adjustment easily the hot platen transition portions can be provided with compartments reducing the bending resistance. The slide shoe can advantageously be heated.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
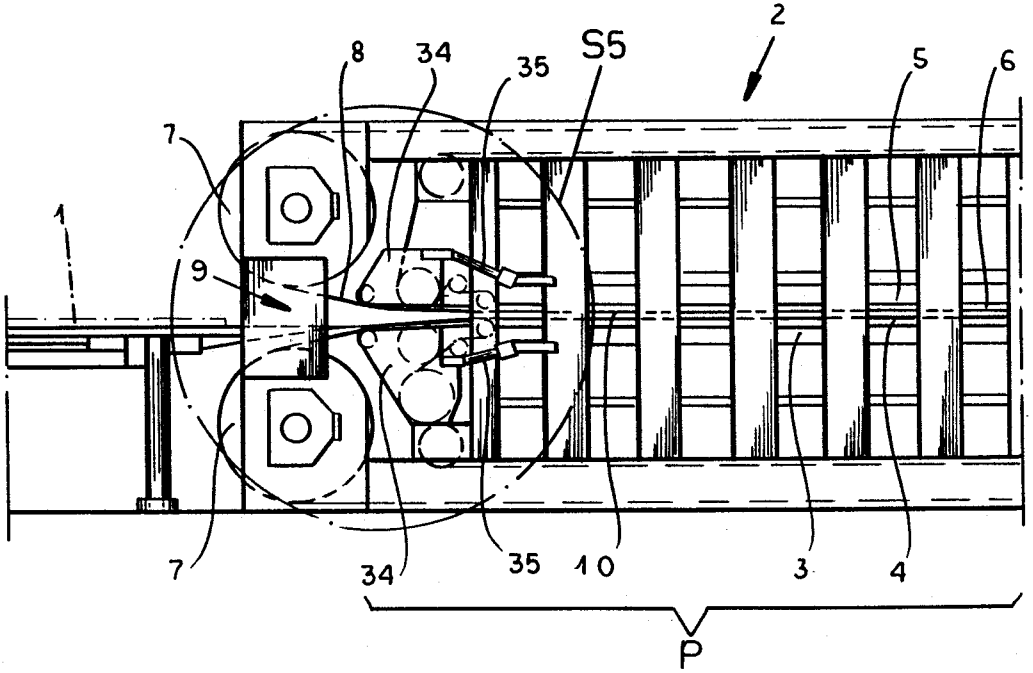
FIG. 1 is a side elevational view of a continuous press according to my invention.
Figure 2:
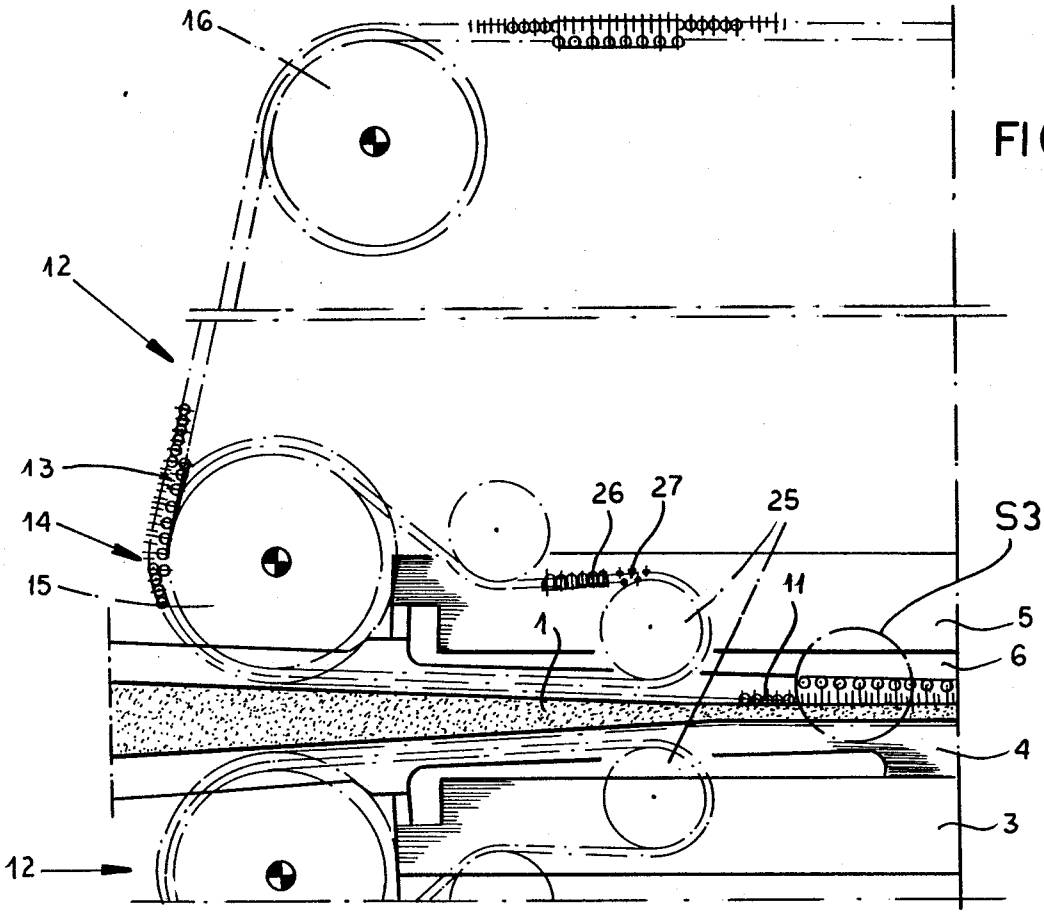
FIG. 2 is a more detailed side view of a feed mechanism of the roll rods at the entrance of the continuous pres of FIG. 1.

The continuously operating press shown in FIG. 1 can hot press a mat 1 to be pressure cast in making fiberboard, chipboard, laminated board or the like.

This continuous press comprises a press frame 2, a lower pressing plate 3 with a heated platen 4, an upper pressing plate 5 with heated platen 6 and endless press belts 8, made for example from steel plate, guided around the upper pressing plate 5 and the lower pressing plate 3. The press belts 8 form an entrance mouth 9 in the vicinity of the guide drums 7 and a press gap 10 in the pressing region P.

The press belts 8 are guided on roll rods 11 in the vicinity of the pressing region P, which move between the heated platens 4, 6 and the press belts 8.

The roll rods 11 are guided with the help of an upper and a lower roll rod circulating mechanism 12 over a guideway about the pressing plates 3, 5. The roll rod guide mechanism comprises guide chains 13 and roll rod feed mechanism 14 with roll rod feed wheels 15.

The roll rod circulating mechanism 12 has a sprocket chain 13 with link pins 18, connecting links 19, 20 and exterior rollers 21 on link pins 18 as well as guide rails 22 for the rollers 21 guided over guide wheel 16 and at least one drive wheel 17. The roll rods 11, which have opposing passages 23 and mounting bolts 24 connected with the sprocket chain 13 insertable in them, are connected with compensating play to the sprocket chain 13.

Roll chains 26 with rolls 27 arranged in a triangular array are guided over guide wheels 25 in the entrance region of the upper pressing plate 5 and also the lower pressing plate 3 at least one of which is drivable.

The roll rods 11 are guided over the rolls 27 of these roll chains 26 in the region between the sprocket chains 13. These components belong to the previously mentioned roll rod feed mechanism 14.

Figure 3:
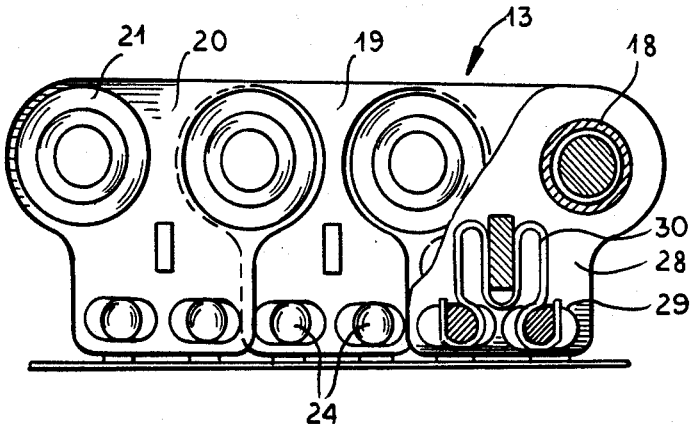
FIG. 3 is a detailed partially cross sectional view of a portion of the continuous press shown in FIG. 1 which is indicated with the dot-dashed circle III.
Figure 4:
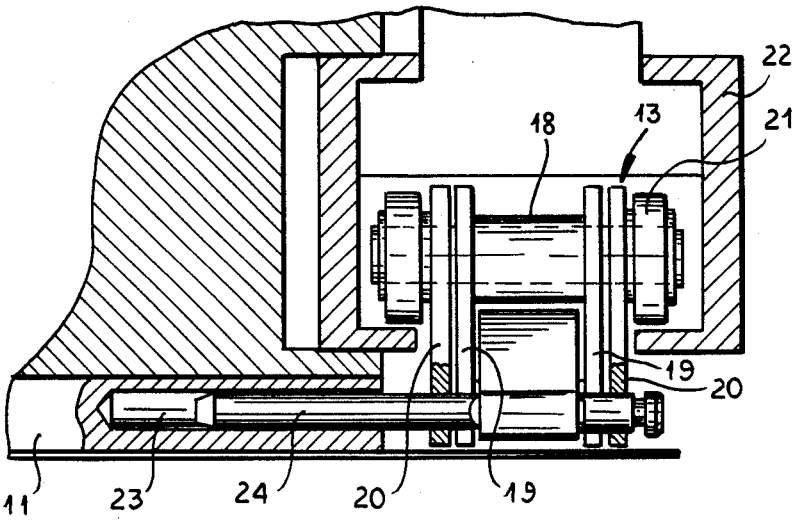
FIG. 4 is cross sectional view of the press of FIG. 1 perpendicular to that of FIG. 3 showing the chain links and how they are guided in the press.

From FIGS. 3 and 4 it can be seen that the connecting links 19, 20 on the side facing the steel plate press belts 8 in the pressing region P facing away from the guide rails 22 are provided with roll rod retaining members 28, which, in harmony with the sprocket chain part dimensions, have elongated holes 29 running in the circulating direction of the sprocket chain 13.

These elongated holes 29 determine the compensating play for the roll rods 11. Furthermore the mounting bolts 24 of the roll rods 11 are mounted in the elongated holes 29; they are centered in the circulating direction without contact (on the edges of the elongated holes) by a centering spring 30 held on the connecting links 19, 20. The sprocket chain 13 has a link pin compensating play between the link pins 18 and the connecting links 19, 20.

Figure 5:
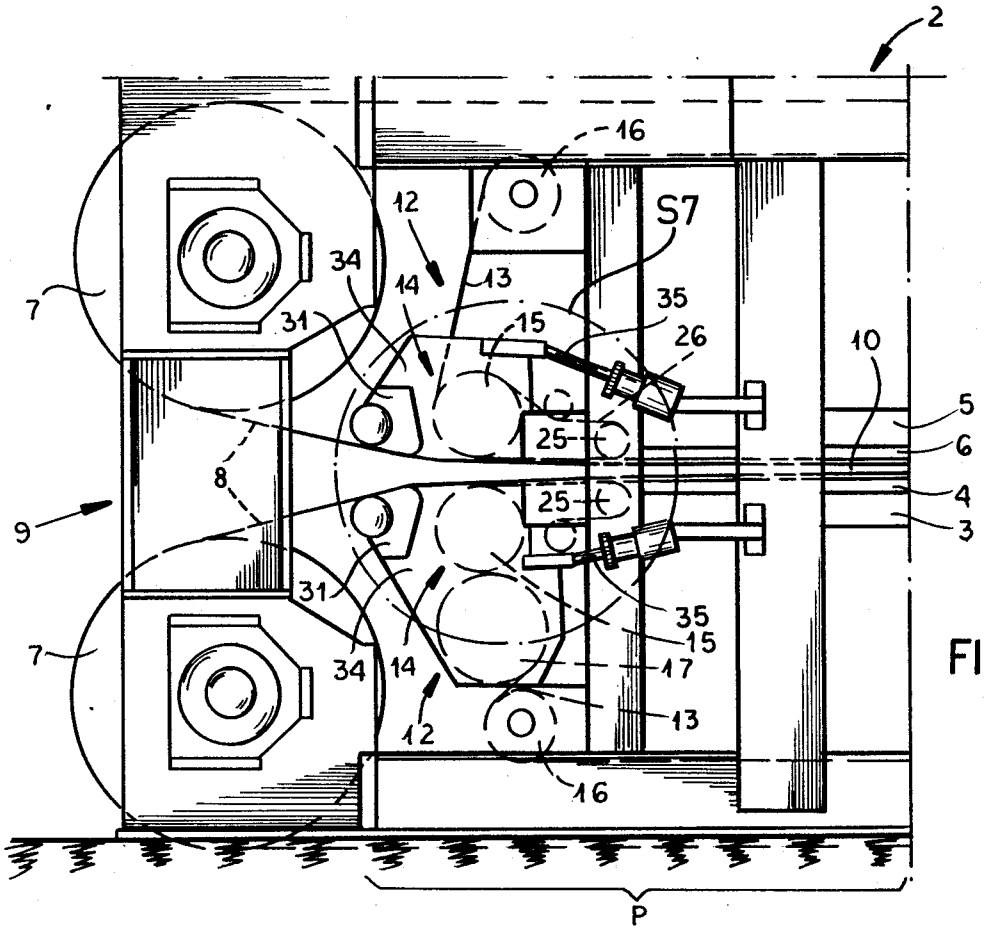
FIG. 5 is a detailed fragmentary side view of a portion of the continuous press shown in FIG. 1 which is indicated with the dot-dashed circle V.

FIG. 5 shows that a roll shoe 31 is arranged on the entrance end of the press in the vicinity between the guide drum 7 for the press belts 8 and the roll rod feed mechanism 14. The associated press belt 8 is guided over the roll shoe 31.

Figure 7:
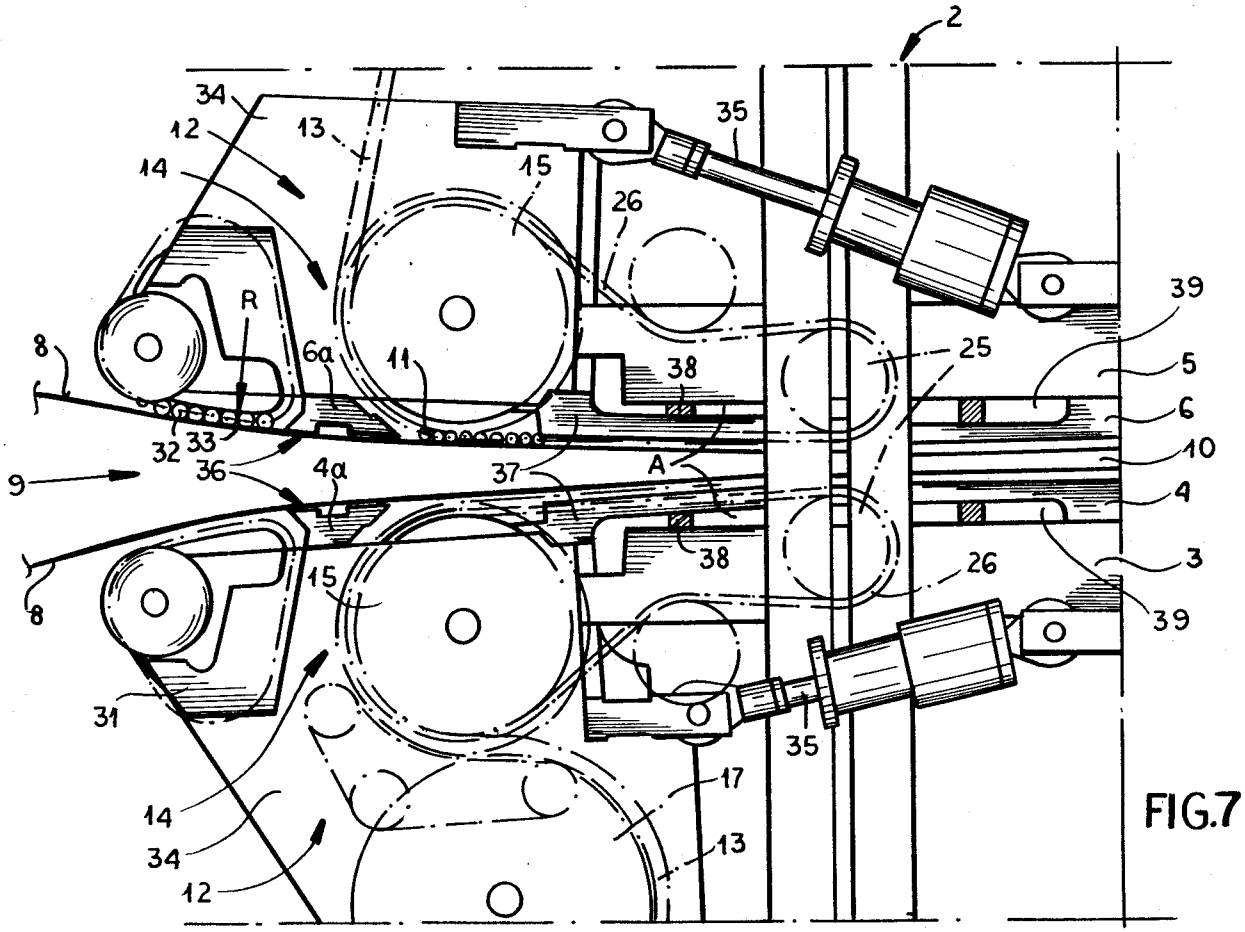
FIG. 7 is a more detailed cutaway side view of a portion of the press of FIG. 1 which is shown in the dot-dashed circle VII of FIG. 5.

The roll shoe 31 has auxiliary rolls 32 (FIG. 7) guided over a guideway which are guided on the press belt side over shape-determining guide surfaces 33. The roll shoe 31 and the entrance-end roll rod feed wheels 15 have one or two part side walls 34, which are connected with hot platen portions 4*a*, 6*a* protruding beyond the pressing plate 5 and/or the pressing plate 3.

Closing piston-cylinder units 35 are connected to the press frame 2 on one end and to these side walls 34 on their other end. The gap width between the roll shoes 31 particularly in the vicinity of the roll rod feed wheels 15 under elastic deformation of the protruding hot platen portions 4*a*, 6*a* is adjustable. Slide shoes 36 are located in the vicinity of the region between the roll shoes 31 and the rod rod feed wheels.

The auxiliary rolls 32 are constructed as rods having the width of the press belts 8. Each has a diameter $d_a$ which is larger by a factor of two than the diameter $d_r$ of the roll rods 11 of the roll rod circulating mechanism 12. The auxiliary rolls 32 are circulated with the aid of unshown chains.

The shape-determining guide surfaces 33 have a radius of curvature R which corresponds approximately with that of the guide drum 7.

Hot platen transition portions 37 are connected in the running direction of the pres belts to the protruding hot platen portions 4*a*, 6*a*. These portions 37 have a clearance space A from the pressing plate 3 and/or the pressing plate 5.

Figure 6:
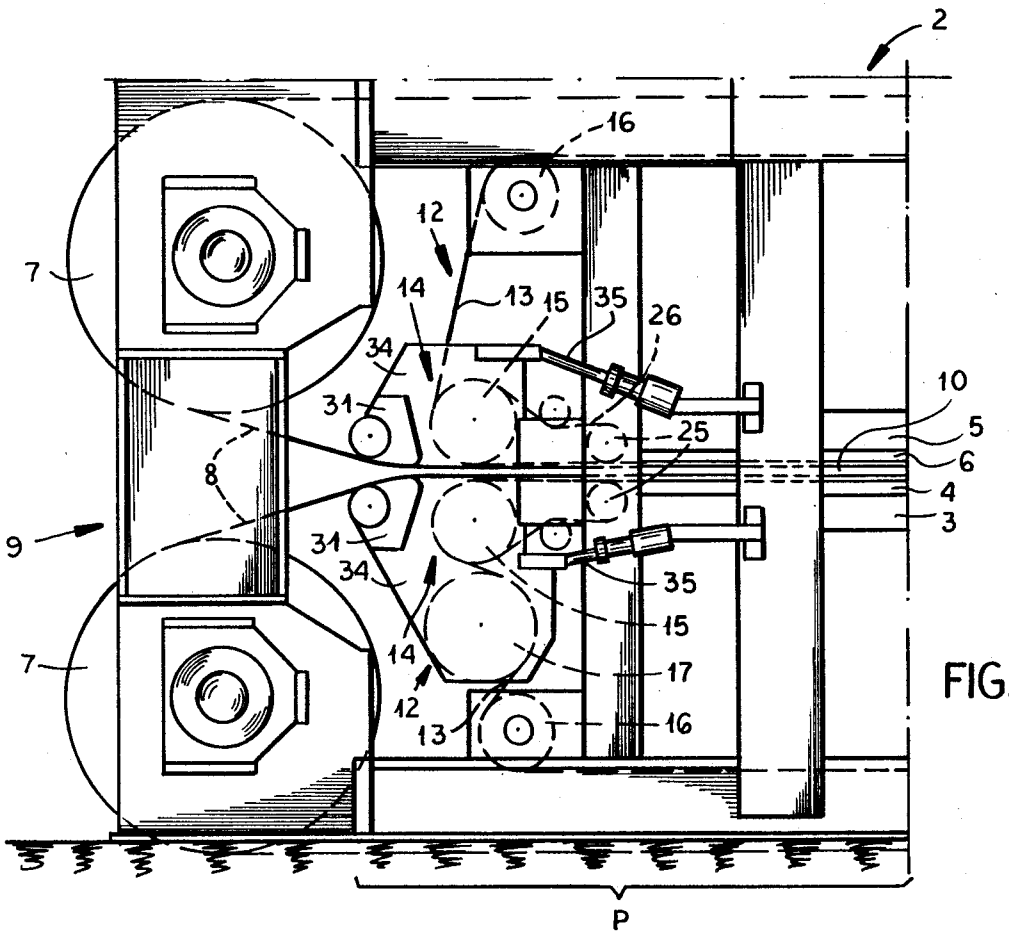
FIG. 6 is another detailed cutaway side view similar to FIG. 5 of the continuous press of FIG. 1 shown in a different operating configuration or state.

In the embodiment of FIG. 6 this clearance space A is deformable elastically on operation of the closing piston-cylinder units 35.

In the embodiment of FIG. 5 wedge or V drive 38 is positioned in the clearance space A between the hot platen transition portions 37 and the pressing plate 3 and/or the pressing plate 5. Because of this the gap 10 between these hot platen transition regions 37 in the running direction of the press belts 8 is variable or it can be shaped as desired. To make the elastic deformation of these regions of the hot platens 4,6 easily, suitable compartments 39 are provided which reduce the bending resistance.

I CLAIM:

1. In a continuous press for hot pressing a mat, comprising a press frame, a lower pressing plate with a heated platen, an upper pressing plate with another heated platen and endless press belts guided about said press plates with the aid of guide drums, which form an entrance mouth in the vicinity of the entrance side of said guide drums and a press gap in a pressing region, in which said press belts are guided in said pressing region on roll rods, which circulate between said heated platens and said press belts, said roll rods being guided around said pressing plates on a guideway with the help of an upper and lower roll rod circulating mechanism having guide chains and a roll rod feed mechanism with entrance-end roll rod feed wheels, the improvement wherein:

a respective roll shoe is located in a region between said guide drums for said press belts and said roll rod fee mechanisms, said press belts are guided by said roll shoes each of which has a plurality of auxiliary rolls guided over another guideway, which are guide d on the press belt side over shape-determining guide surfaces, and said roll shoes and said entrance-end roll rod feed wheels have common side walls, which are connected with hot platen portions protruding beyond said pressing plates, and a closing piston-cylinder unit is connected between said side wall and said press frame, with which a gap width between said roll shoes in the vicinity of said roll rod guide wheels by elastic deformation of said protruding hot platen portions is adjustable.

2. The improvement as defined in claim 1 in which a slide shoe is located in a region between said roll shoes and said roll rod feed wheels.

3. The improvement as defined in claim 1 in which said auxiliary roll has a width equal to that of said press belt and a diameter which is larger by a factor of two than that of said roll rod of said roll rod circulating mechanism.

4. The improvement as defined in claim 1 in which said auxiliary rolls circulated with the help of a driven one of said chains.

5. The improvement as defined in claim 1 in which said shape-determining guide surfaces have a radius of curvature which corresponds approximately to that of said guide drum.

6. The improvement as defined in claim 1 in which a hot platen transition portion extending in the running direction of said press belts is connected to said protruding hot platen portion, said hot platen transition portion having a clearance space between said pressing plate.

7. The improvement as defined in claim 6 in which said hot platen transition portions are deformed elastically similarly on operation of said closing piston-cylinder units.

8. The improvement as defined in claim 6 in which a wedge drive is positioned in said clearance space between said hot platen transition portion and said pressing plate and because of that said press gap is shapable between said hot press transition portions extending in said running direction of said press belts.

9. The improvement as defined in claim 8 in which said hot platen transition portions are provided with a plurality of compartments reducing resistance to bending.

10. The improvement as defined in claim 2 in which said slide shoe in said region between said roll shoe and said roll rod feed wheels is heatable.

11. A continuous press for hot pressing a mat, comprising:

upper and lower pressing plates with heated platens;

press belts which are guided on guide drums and roll rods in a pressing region which runs between said heated platens and said press belts, said roll rods being guided over a guideway around said upper pressing plate and said lower pressing plate with the help of an upper and a lower roll rod circulating mechanism which comprises guide chains and a roll rod feed mechanism with entrance-end roll rod feed wheels;

a roll shoe located at the entrance end in the vicinity of said guide drums for said press belts and said roll rod feed mechanisms, said associated press belts being guided with said roll shoes;

auxiliary rolls for said roll shoes guided over another guideway and which are guided on the press belt side over a plurality of shape-determining guide surfaces, common side walls being provided for said roll shoes and said entrance-end roll guide wheels, which are connected with hot platen portions protruding beyond said pressing plates; and a plurality of closing piston-cylinder units connected between said side walls and said press frame, with which the gap width between said roll shoes in the vicinity of said roll rod feed wheels is adjustable by deformation of said protruding hot platen portions.

12. A continuous press according to claim 11, further comprising:

a heatable slide shoe between each of said roll shoes and said roll rod feed wheels; and a hot platen transition portion extending in the running direction of said press belts connected to said protruding hot platen portions, said hot platen transition region having a clearance space between said pressing plate and said heated platen and being deformed elastically similarly on operation of said closing piston-cylinder unit.

* * * * *